US009706277B2

(12) United States Patent
Tracy

(10) Patent No.: US 9,706,277 B2
(45) **Date of Patent: *Jul. 11, 2017**

(54) ARTICULATING SPEAKER ASSEMBLY PROVIDING FOR PIVOTAL ADJUSTMENT OF CONNECTED FIRST AND SECOND MIDRANGE MEMBERS

(71) Applicant: Dennis A. Tracy, Culver City, CA (US)

(72) Inventor: Dennis A. Tracy, Culver City, CA (US)

( * ) Notice: Subject to any disclaimer, the term of this patent is extended or adjusted under 35 U.S.C. 154(b) by 183 days.

This patent is subject to a terminal disclaimer.

(21) Appl. No.: 14/643,634

(22) Filed: Mar. 10, 2015

(65) Prior Publication Data

US 2015/0189414 A1 Jul. 2, 2015

Related U.S. Application Data

(63) Continuation of application No. 13/949,405, filed on Jul. 24, 2013, now Pat. No. 9,008,337, which is a (Continued)

(51) Int. Cl.
*H04R 1/02* (2006.01)
*H04R 1/26* (2006.01)

(52) U.S. Cl.
CPC ..... *H04R 1/02* (2013.01); *H04R 1/026* (2013.01); *H04R 1/26* (2013.01); *H04R 2201/025* (2013.01); *H04R 2499/13* (2013.01)

(58) Field of Classification Search
CPC ..... H04R 1/02; H04R 1/025; H04R 1/026; H05R 5/02
(Continued)

(56) References Cited

U.S. PATENT DOCUMENTS 4,061,877 A 12/1977 Phillips
4,182,429 A 1/1980 Senzaki
(Continued)

FOREIGN PATENT DOCUMENTS

JP 2005-101988 4/2005

OTHER PUBLICATIONS

Machine Translation of Hamada et al. Japanese Publication No. 2005-101988, Apr. 14, 2005.*
(Continued)

*Primary Examiner* — Ahmad F. Matar
*Assistant Examiner* — Katherine Faley
(74) *Attorney, Agent, or Firm* — Welsh Flaxman & Gitler LLC

(57) ABSTRACT

An articulating speaker assembly includes a first member pivotally connected to a second member for selectively changing the profile of the speaker assembly. A central driver is positioned between the first member and the second member. The first member includes a first enclosure with a cavity shaped and dimensioned for receiving a first driver, the first driver being secured within the first enclosure. The second member includes a second enclosure with a cavity shaped and dimensioned for receiving a second driver, the second driver being secured within the second enclosure. Each of the first member and the second member includes a central driver aperture and the central driver is mounted within the central driver apertures of the first member and the second member.

2 Claims, 8 Drawing Sheets

Related U.S. Application Data continuation of application No. 13/188,016, filed on Jul. 21, 2011, now Pat. No. 8,520,883.

(60) Provisional application No. 61/344,430, filed on Jul. 21, 2010, provisional application No. 61/443,424, filed on Feb. 16, 2011.

(58) Field of Classification Search
USPC ..... 381/86, 345, 182, 186, 386–395, 430; 181/198–199
See application file for complete search history.

(56) References Cited

U.S. PATENT DOCUMENTS

| | | | | |
|---|---|---|---|---|
| 4,199,657 | A | 4/1980 | Lane | |
| 4,597,470 | A | 7/1986 | Takagi et al. | |
| 4,757,544 | A | 7/1988 | Guy | |
| 4,811,406 | A | 3/1989 | Kawachi | |
| 4,882,760 | A | 11/1989 | Yee | |
| 4,932,060 | A | 6/1990 | Schreiber | |
| 4,953,223 | A | 8/1990 | Householder | |
| 5,512,714 | A | 4/1996 | Fenton | |
| 5,677,669 | A | 10/1997 | Walkley, IV et al. | |
| 5,682,434 | A | 10/1997 | Boyden | |
| 5,802,194 | A | 9/1998 | Yamagishi et al. | |
| 6,282,297 | B1 | 8/2001 | Lin | |
| 6,356,640 | B1 | 3/2002 | Lin | |
| 6,466,675 | B1 | 10/2002 | Tracy | |
| 6,968,068 | B1 | 11/2005 | Amsel | |
| 7,036,781 | B1 | 5/2006 | Bothe | |
| 7,206,427 | B2 | 4/2007 | Simidian, II et al. | |
| 7,415,124 | B2 | 8/2008 | Colich | |
| 7,593,536 | B2 | 9/2009 | Sung et al. | |
| 8,520,883 | B2 * | 8/2013 | Tracy | H04R 1/02 381/182 |
| 8,526,662 | B2 | 9/2013 | Tracy | |
| 9,008,337 | B2 * | 4/2015 | Tracy | H04R 1/02 381/182 |
| 2002/0146140 | A1 | 10/2002 | Chiu | |
| 2003/0026446 | A1 | 2/2003 | Davis | |
| 2003/0231782 | A1 | 12/2003 | Engebretson et al. | |
| 2004/0023697 | A1 * | 2/2004 | Komura | H04M 1/0202 455/569.1 |
| 2007/0110267 | A1 | 5/2007 | Liu | |
| 2007/0223735 | A1 * | 9/2007 | LoPresti | H04R 1/24 381/99 |
| 2008/0089537 | A1 | 4/2008 | Scheel et al. | |
| 2008/0123894 | A1 | 5/2008 | Lu | |
| 2008/0240487 | A1 | 10/2008 | Lee | |
| 2008/0267429 | A1 | 10/2008 | Tracy | |
| 2008/0292117 | A1 | 11/2008 | Guenther | |
| 2009/0279732 | A1 | 11/2009 | Maurer et al. | |
| 2010/0046786 | A1 | 2/2010 | Zhen | |
| 2010/0054522 | A1 | 3/2010 | Maurer et al. | |
| 2010/0086163 | A1 * | 4/2010 | Lorenz | H04R 1/2819 381/353 |

OTHER PUBLICATIONS

Hiraga, Jean, "Les Haut-Parleurs", Nov. 2, 2000, Dunod, Paris, SP02675504, ISBN: 2-10-005268-3, Enceinte Jean-Marie Reynaud.

* cited by examiner

ARTICULATING SPEAKER ASSEMBLY PROVIDING FOR PIVOTAL ADJUSTMENT OF CONNECTED FIRST AND SECOND MIDRANGE MEMBERS

CROSS REFERENCE TO RELATED APPLICATIONS

This application is a continuation of U.S. patent application Ser. No. 13/949,405, entitled "ARTICULATING SPEAKER ASSEMBLY PROVIDING FOR PIVOTAL ADJUSTMENT OF CONNECTED FIRST AND SECOND MIDRANGE MEMBERS," filed Jul. 24, 2013, which is a continuation of U.S. patent application Ser. No. 13/188,016, entitled "ARTICULATING SPEAKER ASSEMBLY PROVIDING FOR PIVOTAL ADJUSTMENT OF CONNECTED FIRST AND SECOND MIDRANGE MEMBERS," filed Jul. 21, 2011, which is now U.S. Pat. No. 8,520,883, which claims the benefit of U.S. Provisional Application Ser. No. 61/344,430, entitled "SPEAKER ASSEMBLY HAVING AN ADJUSTABLE PROFILE FOR INTEGRATION INTO PASSENGER SERVICE UNITS OF DIFFERENT SHAPES", filed Jul. 21, 2010, and 61/443,424, entitled "ARTICULATING SPEAKER ASSEMBLY", filed Feb. 16, 2011.

BACKGROUND OF THE INVENTION

1. Field of the Invention

The invention relates to a speaker assembly. More particularly, the invention relates to an articulating speaker assembly for integration within a passenger service unit of an aircraft.

2. Description of the Related Art

The current global community has made it possible for people all around the country, and around the world, to interact for both business and personal reasons. For many people, this requires they spend considerable time traveling from one location to another location. More often than not, these people travel in aircraft. Whether these people travel in private or commercial aircraft, they desire high quality entertainment during the many hours they spend within the confines of an aircraft. However, while high quality entertainment, for example, digital video with CD quality sound, is readily available for theater and home use, the weight, size and available space requirements for use in aircraft make it very difficult to incorporate high fidelity systems within an aircraft. This problem is especially pronounced for audio loudspeaker assemblies when one attempts to meet the size, weight and shape requirements for use in aircrafts.

In the aircraft industry, great priority is placed upon component weight and size reduction. In addition, spacing and positioning of the loudspeaker assemblies are a great priority to those optimizing the operation of aircraft. The size, weight and shape of conventional terrestrial loudspeaker assembly designs adversely affect range and payload. These concerns are notable when one attempts to make changes within smaller, private jets. For example, a small increase in the weight carried by an aircraft results in a substantial increase in fuel consumption of the aircraft. In addition, the limited space available within an aircraft dictates the use of any space within the aircraft be carefully considered by those responsible for ensuring the comfort of passengers.

Lightweight and compact audio loudspeakers are currently available. These loudspeakers, however, substantially compromise sound quality for reductions in size and weight.

An individual wishing to add an audio system to an aircraft must make a choice between high fidelity loudspeakers not suiting the size and weight requirements of the aircraft and lower quality loudspeakers providing desirable size and weight characteristics.

A need, therefore, exists for a loudspeaker assembly providing high fidelity sound, while meeting the size, weight and positioning profile requirements of an aircraft. The present invention provides such a loudspeaker assembly.

SUMMARY OF THE INVENTION

It is, therefore, an object of the present invention to provide an articulating speaker assembly including a first member pivotally connected to a second member for selectively changing a profile of the articulating speaker assembly. The speaker assembly also includes a central driver positioned between the first member and the second member. The first member includes a first enclosure with a cavity shaped and dimensioned for receiving a first driver, the first driver being secured within the first enclosure. The second member includes a second enclosure with a cavity shaped and dimensioned for receiving a second driver, the second driver being secured within the second enclosure. The first member includes a first central driver aperture and the second midrange member includes a second central driver aperture, and the central driver is mounted within the first central driver aperture and the second central driver aperture of the first member and the second member.

It is also an object of the present invention to provide an articulating speaker assembly wherein the first member includes a first face plate secured to the first enclosure, and the first central driver aperture is formed in the first face plate, and the second member includes a second face plate secured to the second enclosure, and the second central aperture is formed in the second face plate.

It is also an object to provide an articulating speaker assembly wherein the first driver is a midrange driver and the second driver is a midrange driver.

It is another object of the present invention to provide an articulating speaker assembly wherein the first face plate includes a first aperture aligned with the first driver and the second face plate includes a second aperture aligned with the second driver.

It is a further object of the present invention to provide an articulating speaker assembly wherein the first face plate is secured to the first enclosure such that a side of the first face plate extends laterally beyond a perimeter defined by the first enclosure and the second face plate is secured to the second enclosure such that a side of the second face plate extends laterally beyond a perimeter defined by the second enclosure.

It is also an object of the present invention to provide an articulating speaker assembly wherein the first central driver aperture is formed in the side of the first face plate extending laterally beyond the perimeter defined by the first enclosure and the second central driver aperture is formed in the side of the second face plate extending laterally beyond the perimeter defined by the second enclosure.

It is another object of the present invention to provide an articulating speaker assembly wherein the side of the first face plate extending laterally beyond the perimeter defined by the first enclosure is secured to the side of the second face plate of the second face plate extending laterally beyond the perimeter defined by the second enclosure with the central driver secured thereto.

It is a further object of the present invention to provide an articulating speaker assembly wherein a center of the second central driver aperture of the second member is aligned with the center of the first central driver aperture of the first member.

It is also an object of the present invention to provide an articulating speaker assembly wherein the central driver is secured to the second face plate with a cone of the central driver aligned with the second central driver aperture, and the first midrange member may selectively rotate relative thereto.

It is another object of the present invention to provide an articulating speaker assembly wherein the central driver is secured to a bottom surface of the second face plate between the second face plate and the first face plate.

It is a further object of the present invention to provide an articulating speaker assembly wherein a rotating spacer with a central aperture is positioned about the central driver secured to the second face plate allowing for selective rotation and locking of the first member and the second member without damaging the central high frequency driver.

It is also an object of the present invention to provide an articulating speaker assembly including a locking plate having a central aperture and aligned with the central driver such that the first face plate and the rotating spacer are held between the locking plate and the second face plate, wherein the second face plate is selectively coupled to the locking plate.

It is another object of the present invention to provide an articulating speaker assembly wherein the central driver is a high frequency driver.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
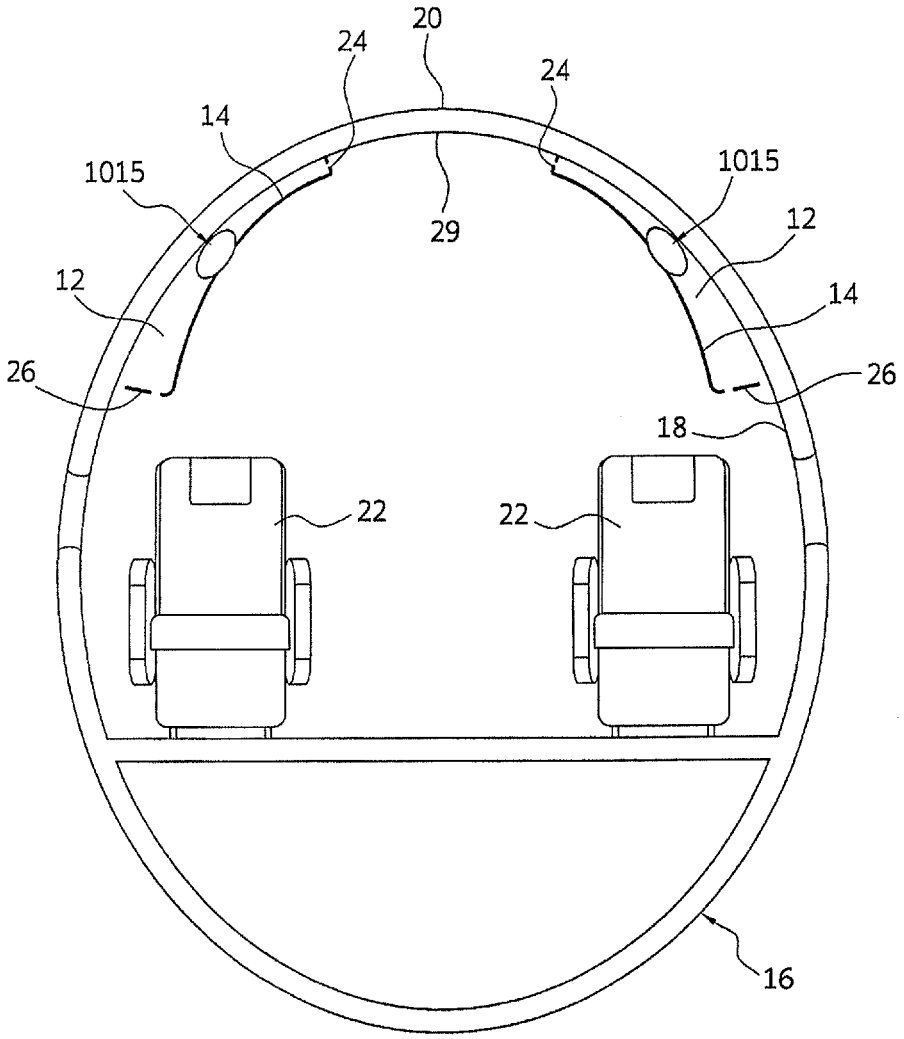
FIG. 1 is a cross sectional schematic of an aircraft fuselage with the present speaker assembly installed.
Figure 2:
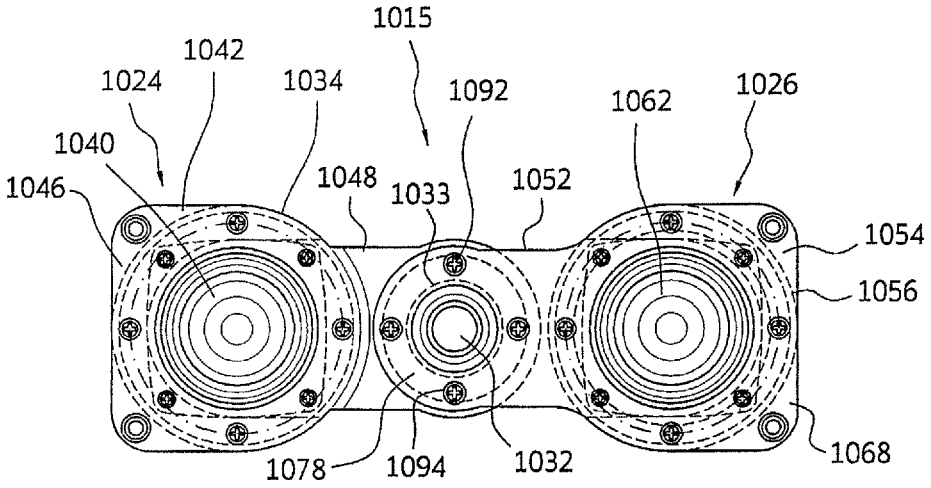
FIG. 2 is a top view of the speaker assembly in accordance with the present invention.
Figure 3:
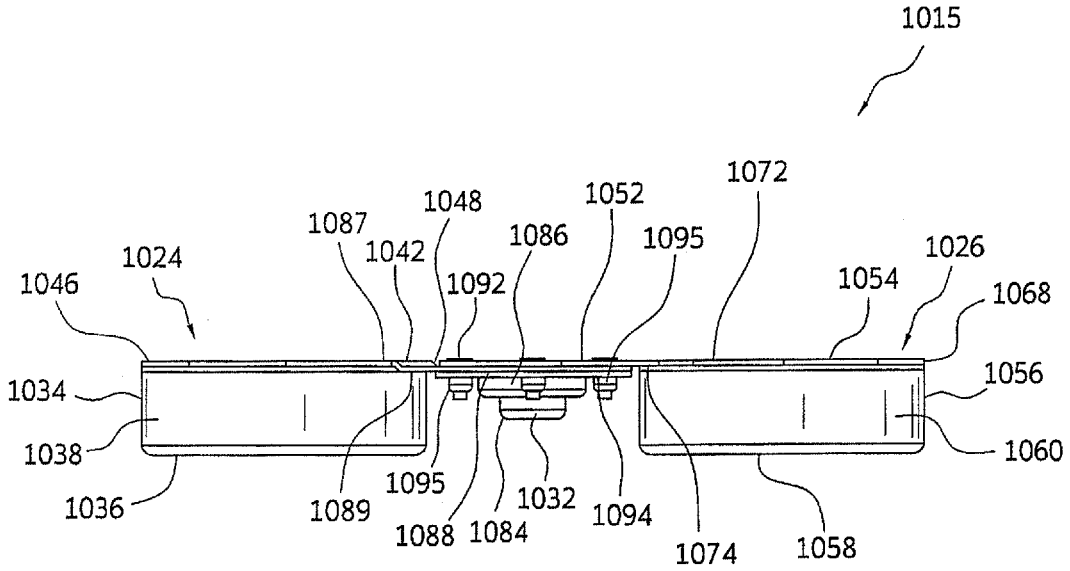
FIG. 3 is a side view of the present speaker assembly along the long side edge.
Figure 4:
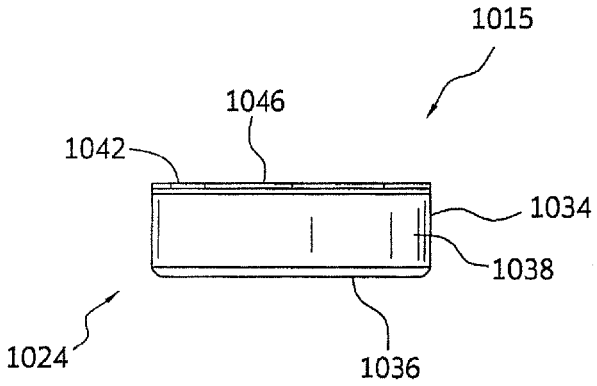
FIG. 4 is a side view of the present speaker assembly along the short side edge.
Figure 5:
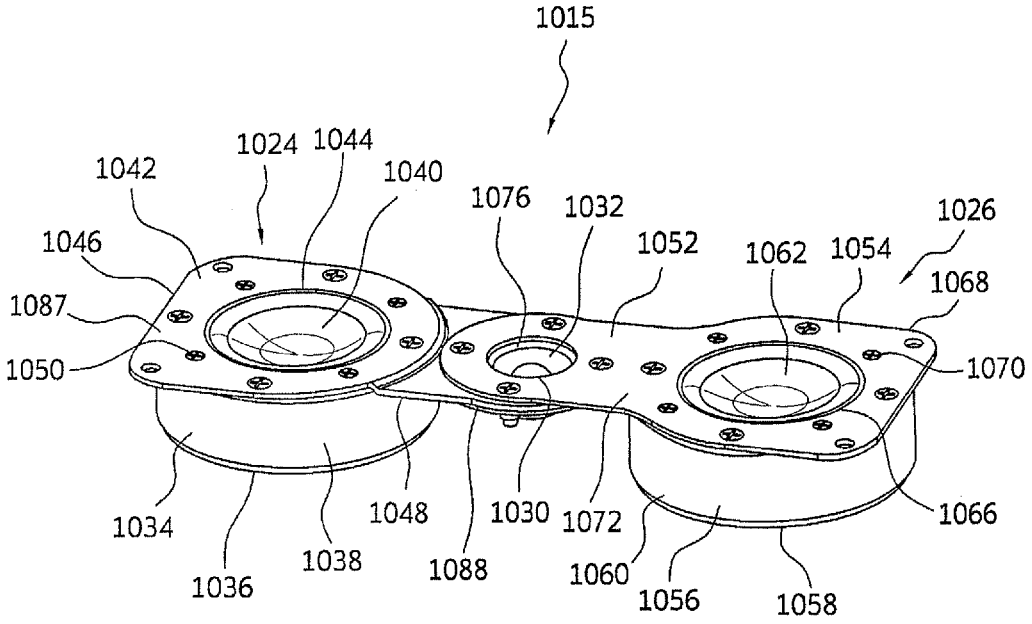
FIGS. 5 and 6 are perspective views of the present speaker assembly in its fully extended configuration with the pivoting midrange members substantially aligned.
Figure 6:
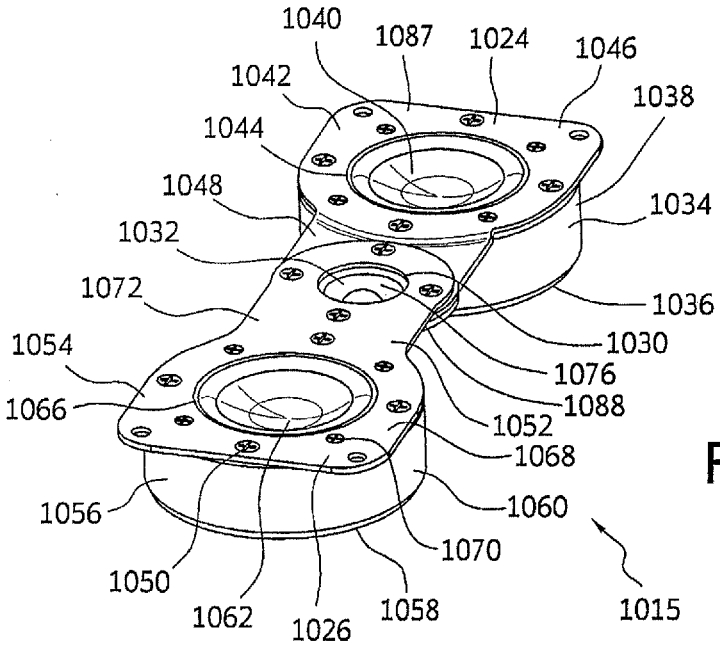
Figure 7:
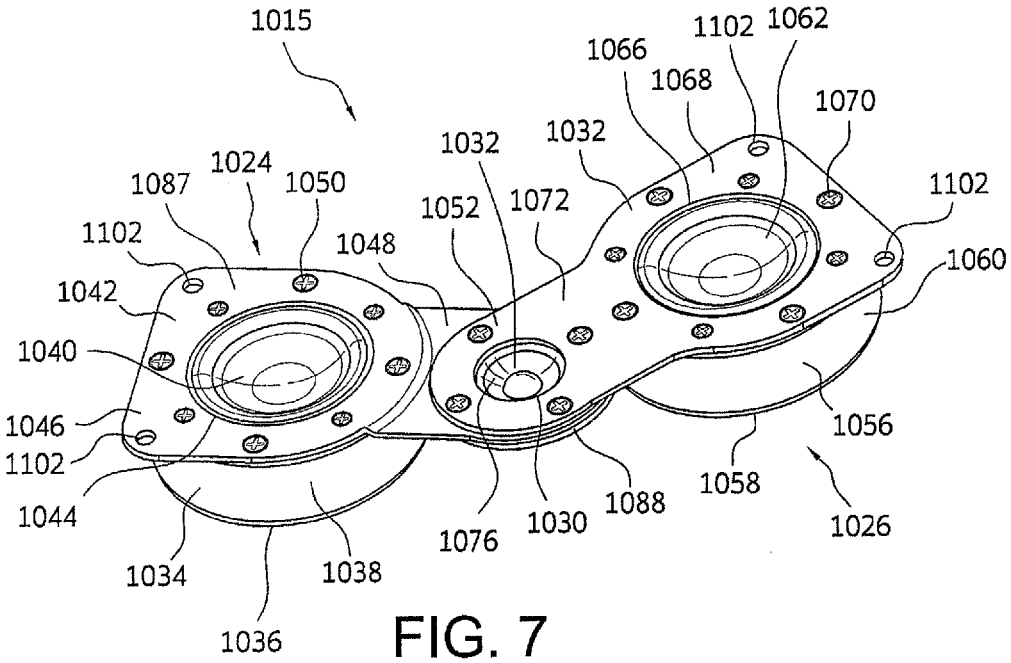
FIGS. 7 and 8 are perspective views of the present speaker assembly with the longitudinal axes of the first and second midrange members respectively rotated to a 45° angle and to a 110° angle relative to the fully extended configuration shown with reference to FIGS. 5 and 6.
Figure 8:
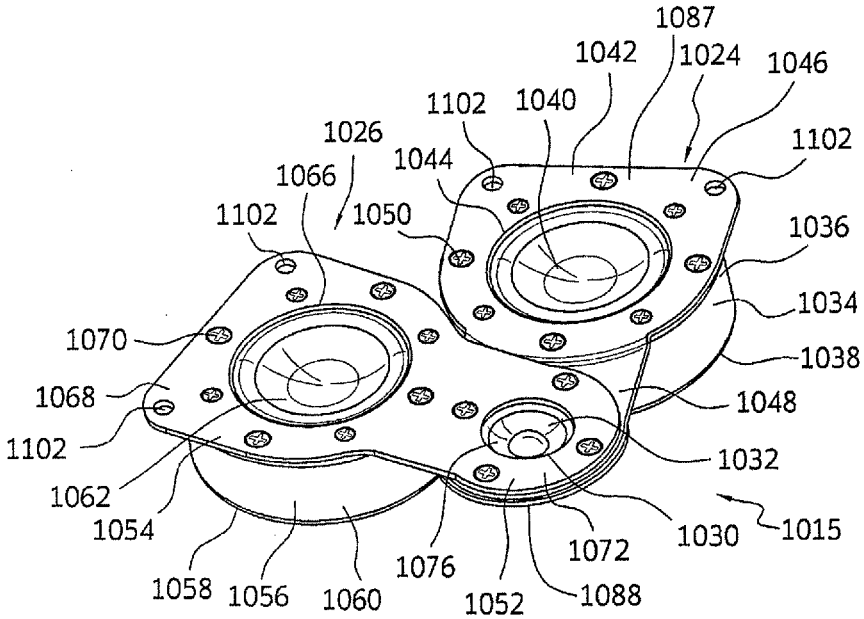
Figure 9:
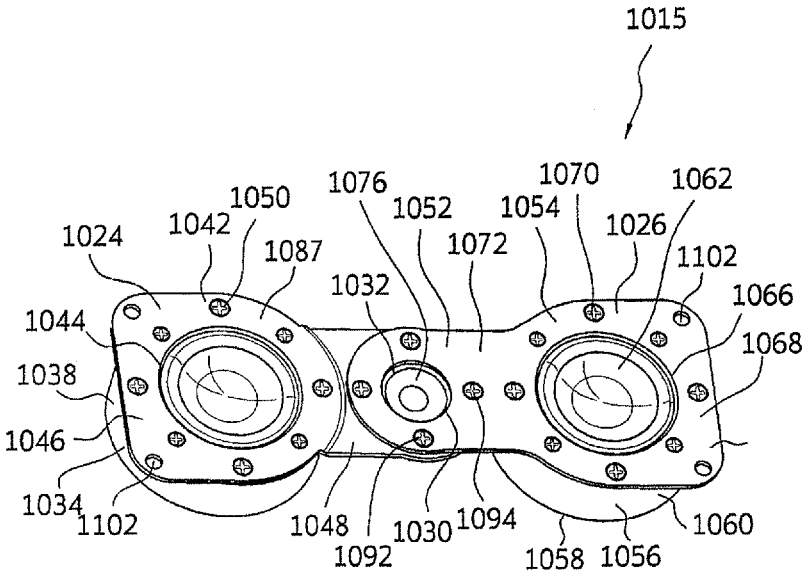
FIGS. 9 and 10 are respectively a top perspective view and a bottom perspective view of the speaker assembly.
Figure 10:
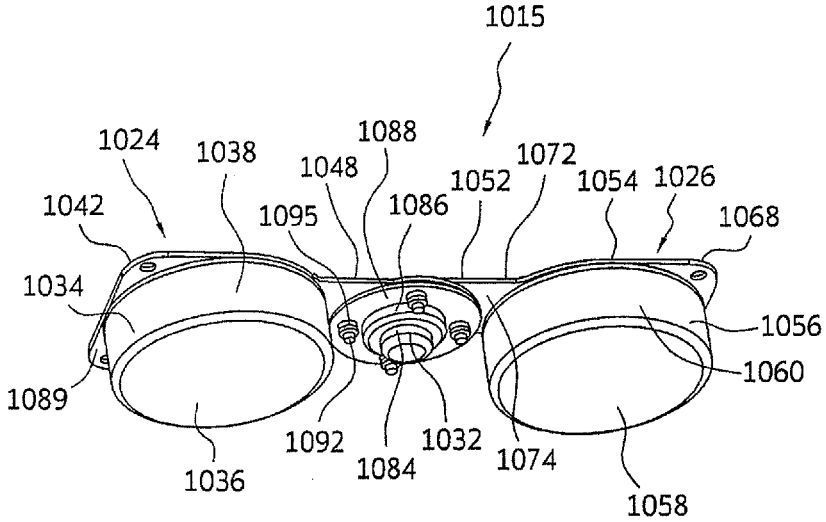
Figure 11:
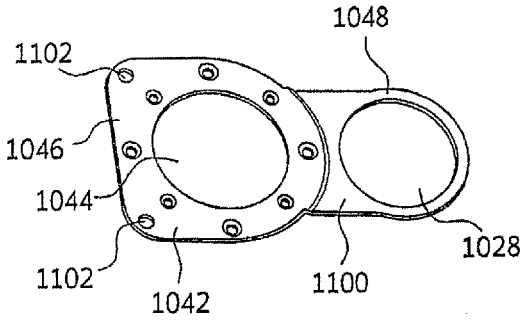
FIGS. 11, 12 and 13 are perspective views respectively showing the top plate of the first midrange member, the nylon rotating spacer, and the locking plate.
Figure 12:
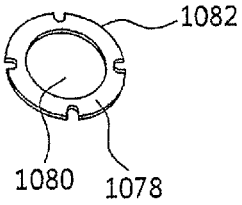
Figure 13:
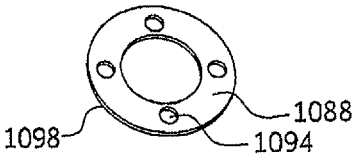
Figure 14:
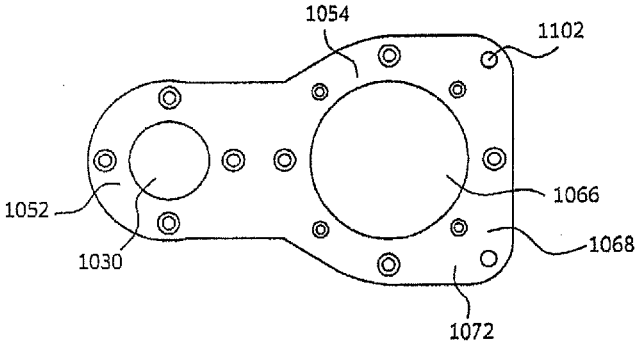
FIG. 14 is a top view of the second midrange member.
Figure 15:
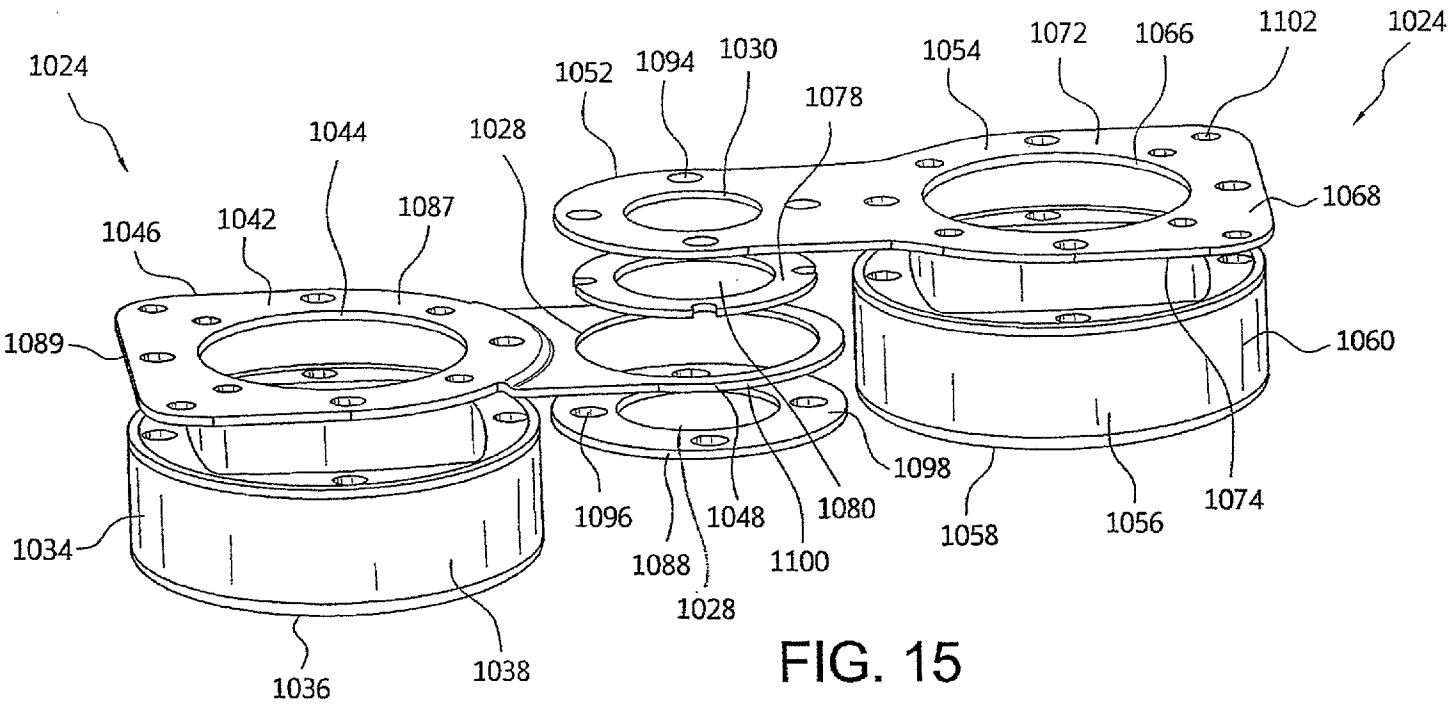
FIG. 15 is an exploded perspective view of the speaker assembly shown in FIG. 2.

In accordance with the present invention, and with reference to FIG. 1, a representative small profile speaker assembly 1015 shaped and dimensioned for positioning within an internal cavity 12 of a passenger service unit 14 of an aircraft 16 is disclosed.

As will be appreciated by those skilled in the art, a passenger service unit 14 is a structural element of an aircraft 16 in which those accessories providing for passenger comfort and service are positioned. The passenger service unit 14 is commonly positioned along the interior wall 18 of the aircraft fuselage 20 above the side window and directly above the passenger seat 22 allowing for direct access by passengers sitting in the seats adjacent thereto. The passenger service unit 14 commonly houses air flow devices (for example, an aircraft gasper), lights, public address speakers, messaging buttons for contacting the flight attendants, and various warning lights. In addition, and in accordance with many aircraft designs, the lateral edges 24, 26 of the passenger service unit 14 allow for creation and transmission of up-wash light and down-wash light. Depending upon the specific aircraft and the custom interior design thereof, the passenger service unit may take a variety of shapes. In fact, most passenger service units exhibit different and changing profiles along their length and width.

In particular, the passenger service unit 14 extends along the longitudinal axis of the aircraft 16 from the aft of the aircraft 16 to the fore of the aircraft 16. In accordance with the present invention, the passenger service unit 14 is provided with an internal cavity 12 through which light, electrical wires and other functional components are run along the length of the aircraft 16. In accordance with a preferred embodiment of the present invention, a plurality of speaker assemblies 1015 are positioned within the internal cavity 12 at locations along the length of the aircraft 16. The articulating speaker assembly 1015 described below allows for ready adjustment so the speaker assembly 1015 may be fit within different locations without entirely redesigning the speaker assembly. That is, different locations along a passenger service unit 14, as well as different passenger services units, will have different curvatures and shapes necessitating changes in the shape of a speaker mounted therein. In addition, articulation of the speaker assembly 1015 allows for changes in the shape of a grill improving aesthetics and controlling crossovers.

In accordance with a preferred embodiment, the speaker assembly 1015 incorporates a variety of features which reduce the size and weight of the speaker assembly, allowing for positioning at various locations within the internal cavity 12 of the passenger service unit 14 by simply adjusting the orientation of the speaker assembly 1015 without compromising the integrity of the sound generated by the speaker assembly 1015.

With reference to FIGS. 2 to 15, the speaker assembly 1015 includes first and second midrange members 1024, 1026 pivotally connected for selectively changing the profile of the speaker assembly and allowing for positioning within a variety of envelopes within an aircraft, in particular, the passenger service unit 14 of the aircraft. The first and second midrange members 1024, 1026 are substantially mirror images of each other and include overlapping circular apertures (that is, high frequency apertures 1028, 1030) within which a high frequency driver (or central driver) 1032 is mounted.

With reference to first midrange member 1024, it includes a first cylindrical enclosure 1034 with a first base wall 1036 and a circular first sidewall 1038. The first cylindrical enclosure 1034 defines a cavity shaped and dimensioned for receiving a first midrange driver 1040. The first midrange driver (or first driver) 1040 is secured within the first cylindrical enclosure 1034 via a first face plate 1042.

The first face plate 1042 includes a top surface 1087 and a bottom surface 1089. The first face plate 1042 also includes a first midrange aperture 1044 along a first side 1046 thereof and the first high frequency aperture (or first central driver aperture) 1028 along the opposite second side 1048 thereof. The first midrange driver 1040 is secured to the first face plate 1042 using conventional adhesive and the first face plate 1042 is then secured to the first cylindrical enclosure 1034 using screws 1050 with the first midrange driver 1040 positioned within the cavity defined by the first cylindrical enclosure 1034. The first face plate 1042 is secured to the first cylindrical enclosure 1034 such that the opposite second side 1048 of the first face plate 1042 extends laterally beyond the perimeter defined by the first sidewall 1038 of the first cylindrical enclosure 1034 such that the second side 1048 of the first face plate 1042 may be secured to the second side 1052 of the second face plate 1054 with the high frequency driver 1032 secured thereto.

With reference to the second midrange member 1026, it includes a second cylindrical enclosure 1056 with a second base wall 1058 and circular second sidewall 1060. The second cylindrical enclosure 1056 defines a cavity shaped and dimensioned for receiving a second midrange driver (or second driver) 1062. The second midrange driver 1062 is secured within the second cylindrical enclosure 1056 via a second face plate 1054.

The second face plate 1054 includes a second midrange aperture 1066 along a first side 1068 thereof and a second high frequency aperture (or second central driver aperture) 1030 along the opposite second side 1052 thereof. The second midrange driver 1062 is secured to the second face plate 1054 using conventional adhesive and the second face plate 1054 is then secured to the second cylindrical enclosure 1056 using screws 1070 with the second midrange driver 1062 positioned within the cavity defined by the second cylindrical enclosure 1056. The second face plate 1054 is secured to the second cylindrical enclosure 1056 such that the opposite second side 1052 of the second face plate 1054 extends laterally beyond the perimeter defined by the second sidewall 1060 of the second cylindrical enclosure 1056 such that the second side 1052 of the second face plate 1054 may be secured to the second side 1048 of the first face plate 1042 with the high frequency driver 1032 secured thereto.

With the center of the second high frequency aperture 1030 of the second midrange member 1026 aligned with the center of the first high frequency aperture 1028 of the first midrange member 1024, the first and second midrange members 1024, 1026 are selectively coupled for relative movement and subsequent tightening to secure the first and second midrange members 1024, 1026 in desired orientations. More particularly, the second face plate 1054 includes a top surface 1072 and a bottom surface 1074, and the outer ring 1033 of the high frequency driver 1032 is adhesively secured to the bottom surface 1074 of the second face plate 1054 with the cone 1076 of the high frequency driver 1032 aligned with the second high frequency aperture 1030.

A nylon rotating spacer 1078 with a central aperture 1080 is then positioned about the outer ring 1033, that is, around the outer ring 1033 such that the outer ring 1033 sits within the central aperture 1080 of the rotating spacer 1078, of the high frequency driver 1032 secured to the bottom surface 1074 of the second face plate 1054 allowing for selective rotation and locking of the first and second midrange members 1024, 1026 without damaging the high frequency driver 1032. The rotating spacer 1078 includes a central aperture 1080 large enough for the passage of the outer ring 1033, magnet 1084, cone 1076 and downwardly extending housing structure 1086 of the high frequency driver therethrough.

The first high frequency aperture 1028 is then aligned with the high frequency driver 1032 such that the outer circumference 1082 of the rotating spacer 1078 is positioned within the first high frequency aperture 1028 of the first face plate 1042 of the first midrange member 1024 such that the rotating spacer 1078 and the first face plate 1042 lie in the same plane. This arrangement aligns the second side 1048 of the first face plate 1042, the rotating spacer 1078 and the outer ring 1033 of the high frequency driver 1032 such that the bottom surface 1074 of the second face plate 1054 is in contact with the top surface 1087 of the first face plate 1042.

The assembly is finished with a locking plate 1088, having a central aperture 1090, aligned with the high frequency driver 1032 such that the second side 1048 of the first face plate 1042 and the rotating spacer 1078 are held between the locking plate 1088 and the second side 1052 of the second face plate 1054. The aligned assembly is held together by screws 1092 passing through apertures 1094 formed in the second side 1052 of the second face plate 1054 at spaced positions about the second high frequency aperture 1030 and aligned apertures 1096 formed in the locking plate 1088. Nuts 1095 are employed to secure the screws 1092. As such, by tightening or loosening the screws 1092 one is able to release the first and second midrange members 1024, 1026 (which are in contact via the bottom surface 1074 of the second face plate 1054 and the top surface 1087 of the first face plate 1042) for relative pivotal adjustment and then selectively tighten the screws 1092 to lock the relative position when a desired orientation is achieved.

It should be appreciated the spacing and sizing of the high frequency driver 1032, rotating spacer 1078, locking plate 1088, screw apertures 1094, 1096 and first high frequency aperture 1028 of the first face plate 1042 are such that the screws 1092 pass within the first high frequency aperture 1028 while the edge 1098 of the locking plate 1088 engages the first face plate 1042 about the edge 1100 of the first high frequency aperture 1028 upon tightening of the nuts 1095 on the screws 1092 to pull the first face plate 1042 into selective contact with the second face plate 1054.

In addition to the adjustment feature discussed above, the first face plate 1042 and the second face plate 1054 are respectively provided with wall mounts 1102 extending beyond the circumference of the respective first and second cylindrical enclosures 1034, 1056. The wall mounts 1102 are shaped and dimensioned to facilitate attachment to mounting brackets (not shown) of the aircraft. The wall mounts 1102 are adapted to facilitate the installation of the present speaker assembly 1010 within an aircraft fuselage. It will be appreciated that although wiring diagrams are not disclosed herein, the present speaker assembly 10 is wired in a conventional manner.

Installation of the speaker assembly 1015 is completed by mounting the speaker assembly 1015 at a desired location within the internal cavity of the passenger service unit 14. However, and although mounting within the passenger service unit 14 is contemplated in accordance with the present invention, it is appreciated the speaker assemblies may be mounted at various locations.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An articulating speaker assembly, comprising:

a first member pivotally connected to a second member for selectively changing a profile of the articulating speaker assembly;

a central speaker driver with a cone for generating sound positioned between the first member and the second member, wherein the central speaker driver is a high frequency driver;

the first member includes a first enclosure with a first speaker driver, wherein the first speaker driver is a midrange driver and the first member includes a first exterior base wall and a first exterior side wall defining the first enclosure;

the second member includes a second enclosure with a second speaker driver, wherein the second speaker driver is a midrange driver and the second member includes a second exterior base wall and a second exterior side wall defining the second enclosure, the second enclosure being structurally and functionally the same as the first enclosure;

wherein the first member includes a first central driver aperture and the second member includes a second central driver aperture, and the central speaker driver is mounted within the first central driver aperture and the second central driver aperture of the first member and the second member;

wherein a center of the second central driver aperture of the second member is aligned with a center of the first central driver aperture of the first member, such that the first member and the second member may rotate relative to each other.

2. An aircraft including an articulating speaker assembly, comprising:

a fuselage including an interior wall along which a passenger service unit is positioned, an articulating speaker assembly being secured to the passenger service unit, the articulating speaker assembly including:

a first member pivotally connected to a second member for selectively changing a profile of the articulating speaker assembly;

a central speaker driver with a cone for generating sound positioned between the first member and the second member, wherein the central speaker driver is a high frequency driver;

the first member includes a first enclosure with a first speaker driver, wherein the first speaker driver is a midrange driver;

the second member includes a second enclosure with a second speaker driver, wherein the second speaker driver is a midrange driver;

wherein the first member includes a first central driver aperture and the second member includes a second central driver aperture, and the central speaker driver is mounted within the first central driver aperture and the second central driver aperture of the first member and the second member;

wherein a center of the second central driver aperture of the second member is aligned with a center of the first central driver aperture of the first member, such that the first member and the second member may rotate relative to each other.

* * * * *